US009370234B2

(12) United States Patent
Lhoyer

(10) Patent No.: US 9,370,234 B2
(45) Date of Patent: Jun. 21, 2016

(54) COSMETIC PRODUCT APPLICATOR COMPRISING AN ELONGATE PORTION COATED WITH A LOBE

(71) Applicant: ALBEA SERVICES, Gennevilliers (FR)

(72) Inventor: Patrick Lhoyer, Mouy (FR)

(73) Assignee: ALBEA SERVICES, Gennevilliers (FR)

( * ) Notice: Subject to any disclaimer, the term of this patent is extended or adjusted under 35 U.S.C. 154(b) by 235 days.

(21) Appl. No.: 14/093,220

(22) Filed: Nov. 29, 2013

(65) Prior Publication Data

US 2014/0153995 A1 Jun. 5, 2014

(30) Foreign Application Priority Data

Nov. 30, 2012 (FR) ..... 12 61518

(51) Int. Cl.

| | |
|---|---|
| ***A46D 3/04*** | (2006.01) |
| ***A45D 40/26*** | (2006.01) |
| ***A46B 9/00*** | (2006.01) |
| ***A46D 3/00*** | (2006.01) |
| ***A46B 9/02*** | (2006.01) |
| ***A46D 1/00*** | (2006.01) |

(52) U.S. Cl.

CPC ..... *A45D 40/262* (2013.01); *A46B 9/00* (2013.01); *A46B 9/021* (2013.01); *A46D 1/0284* (2013.01); *A46D 3/00* (2013.01); *A46D 3/005* (2013.01); *A46B 2200/1053* (2013.01)

(58) Field of Classification Search

CPC ..... A46D 3/00; A46D 3/005; A46D 1/0284

USPC ..... 300/21

See application file for complete search history.

(56) References Cited

U.S. PATENT DOCUMENTS

| | | | | |
|---|---|---|---|---|
| 4,724,569 | A * | 2/1988 | Eguchi | A46B 9/04 15/167.1 |
| 5,015,504 | A | 5/1991 | Gent et al. | |
| 5,197,497 | A | 3/1993 | Gueret | |
| 5,345,644 | A * | 9/1994 | Gueret | A46B 3/18 132/218 |
| 5,836,033 | A * | 11/1998 | Berge | A46B 9/06 15/110 |
| 6,543,083 | B1 * | 4/2003 | Edwards | A46B 3/00 15/159.1 |
| 2010/0269841 | A1 | 10/2010 | Honnefeller et al. | |
| 2011/0229246 | A1 | 9/2011 | Kulik | |
| 2012/0174941 | A1 | 7/2012 | Gueret | |

FOREIGN PATENT DOCUMENTS

| | | |
|---|---|---|
| EP | 0250670 | 1/1988 |

* cited by examiner

*Primary Examiner* — Jennifer C Chiang

(74) *Attorney, Agent, or Firm* — Steven M. Greenberg, Esq.; CRGO Law

(57) ABSTRACT

An applicator is provided for a cosmetic product, in particular mascara. The applicator includes a brush which includes a core and fibers projecting from the core. At least one of the fibers includes an elongate portion made of a first material and a lobe arranged at an end of the elongate portion. The lobe in turn is made of a second material coating an end of the elongate portion.

6 Claims, 12 Drawing Sheets

COSMETIC PRODUCT APPLICATOR COMPRISING AN ELONGATE PORTION COATED WITH A LOBE

CROSS REFERENCE TO RELATED APPLICATIONS

This application claims priority under 35 U.S.C. §119(a) to French Patent Application Serial Number 1261518, filed Nov. 30, 2012, entitled "A COSMETIC PRODUCT APPLICATOR COMPRISING AN ELONGATE PORTION COATED WITH A LOBE," the entire teachings of which are incorporated herein by reference.

BACKGROUND OF THE INVENTION

1. Field of the Invention

The invention generally relates to the field of distributor-applicators for packaging liquid or pasty cosmetic products. More precisely, the invention relates to a method for producing a cosmetic product applicator, in particular a make-up brush, more particularly for applying make-up to the eyes, such as a mascara brush, and to an associated cosmetic product applicator.

2. Description of the Related Art

A cosmetic product distributor-applicator, in particular for cosmetic product to be applied to the eyelashes, such as mascara, includes a receptacle containing the cosmetic product and an applicator capable of being removably attached to the receptacle.

The receptacle generally includes a body, the body including walls which delimit a container which contains the cosmetic product, and a neck defining an opening through which the cosmetic product can be removed.

The applicator generally includes a cap which is used as a handle and is capable of being attached to the neck, a rod extending from the cap and a brush attached to a free end of the rod. The brush includes a core and a plurality of fibers extending from the core, the fibers being relatively short elements made of a material of which the thickness (or the diameter) is very low compared with the length.

When the cap is attached to the neck, the rod and the brush extend within the container. The brush is immersed in the cosmetic product contained in the container.

To use the applicator, the user detaches the cap from the neck and removes the applicator from the receptacle. The user applies the product to the eyelashes using the brush, and this has the effect of coating the eyelashes with a film of cosmetic product.

In addition, during application, the user uses the brush to shape the eyelashes, for example by curling them to make them appear longer. As the film of cosmetic product deposited on the eyelashes dries, it holds the eyelashes in the desired shape.

Common cosmetic product applicators, and in particular mascara brushes, often comprise bristles arranged helically around the core made up of two twisted metal wires. Each bristle includes two fibers projecting from the core in radial directions and formed in one piece.

However, there are drawbacks characteristic of the aforementioned cosmetic-applicator brushes. Specifically, the fibers used generally have a low diameter (typically of between 3 and 5 millimeters (or between approximately 75 and 125 microns)). In addition, the fibers are distributed over the core at a density of approximately 20 to 160 fibers per turn of the core. Owing to this high density, the applicator makes it possible to effectively coat the eyelashes, that is to say to properly separate the eyelashes. However, little cosmetic product can be loaded onto the brush, which makes it difficult and time-consuming for the user to appropriately coat the eyelashes using the make-up product.

It would be possible to produce applicators from fibers having a larger diameter than conventional fibers, and to distribute said fibers at a lower density (since the increase in diameter of a fiber reduces the space available for the fibers per turn of the core). This would result in the fibers being mutually spaced further apart. The diameter of the fibers would typically be between 6 and 12 millimeters (or between approximately 150 and 300 microns), whereas the density of the fibers would be lower and would be approximately 10 to 80 fibers per turn of the core (compared with a conventional density of approximately 10 to 80 fibers per turn of the core). It would thus become possible to load the brush with more product. In addition, when applying the product to the eyelashes, the spacing of the fibers resulting from the low density thereof and from the large diameter thereof would make it possible for the eyelashes to better penetrate the brush and therefore for the eyelashes to be better coated.

However, since the diameter of the fibers is larger, said fibers are also more rigid, which reduces the ease of use of the brush and causes an unpleasant sensation for the user. What is more, the brush could prove dangerous to a user and could be liable to injure the user's eyes.

BRIEF SUMMARY OF THE INVENTION

Embodiments of the present invention address deficiencies of the art in respect to cosmetic applicators and provide a novel and non-obvious applicator, in particular for mascara, which is capable of depositing a large quantity of product on the eyelashes, while maintaining its ease of application and minimising the risk of injury to the eyes of the user if mishandled.

For this purpose, the invention proposes an applicator for a cosmetic product, in particular mascara, that includes a brush which includes a core and fibers projecting from the core, at least one of said fibers, in particular each of said fibers, including an elongate portion made of a first material and a lobe arranged at an end of the elongate portion, the lobe being made of a second material coating an end of the elongate portion.

Some preferred but non-limiting features of the applicator are as follows:

the fibers project from the core in radial directions, the first material includes an elastomeric polyester, polyester or nylon 6/12, the fibers are distributed helically around the core at a density of between eight and eighty fibers per turn of the helix about the core, each elongate portion having a diameter of between 150 and 300 microns, the elongate portions of the fibers are formed by plastics injection moulding together with the core, the elongate portions of the fibers are formed in one piece together with the core, the second material includes a resin, the resin includes a two-component epoxy adhesive or an ultraviolet adhesive, the second material includes a dye, the brush has a series of angular sectors extending radially around the core, each angular sector including at least one fiber, and wherein only one part of said angular sectors includes fibers including a lobe, and the brush has a series of angular sectors extending radially around the core, only some of the angular sectors including at least one fiber including a lobe, the rest of the angular sectors not having fibers.

According to a second aspect, the invention also proposes a distributor-applicator for a cosmetic product, in particular mascara, characterized in that it includes a cosmetic product applicator as described above, and a receptacle including a body forming a container containing a cosmetic product.

According to a third aspect, the invention proposes a method for producing a cosmetic product applicator of this type, including a step during which all or some of the free ends of the elongate portions are dipped into the second material in order to coat each free end of said elongate portions with the second material to form the lobe.

Some preferred but non-limiting features of the production method are as follows:

only the free ends of the elongate portions are dipped into the second material, the brush has a series of angular sectors, each including at least one fiber which extends in a longitudinal direction of said core, and, during the dipping step, the free ends of the elongate portions are immersed sector by sector in a tray containing the second material, during the step of dipping the elongate portions, the brush is moved in translation parallel to a free surface of the second material contained in the tray at a speed of movement in translation, and is simultaneously driven in rotation about a longitudinal axis of the core at a speed of rotation, the speeds being such that the instantaneous speed of a free end of an elongate portion relative to the core is equal to the speed of movement in translation of the brush relative to the tray, such that the brush rolls in the tray, prior to the dipping step, all or some of the elongate portions of at least one sector are cut, the step of dipping one elongate portion into the second material is repeated at least once, preferably twice, the method further includes a treatment step involving polymerisation of the second material coating the end of all or some of the elongate portions.

BRIEF DESCRIPTION OF THE SEVERAL VIEWS OF THE DRAWINGS

Other features, aims and advantages of the present invention will be better understood upon reading the following detailed description with reference to the accompanying drawings given by way of non-limiting example, in which.

DETAILED DESCRIPTION OF THE INVENTION

Figure 1:
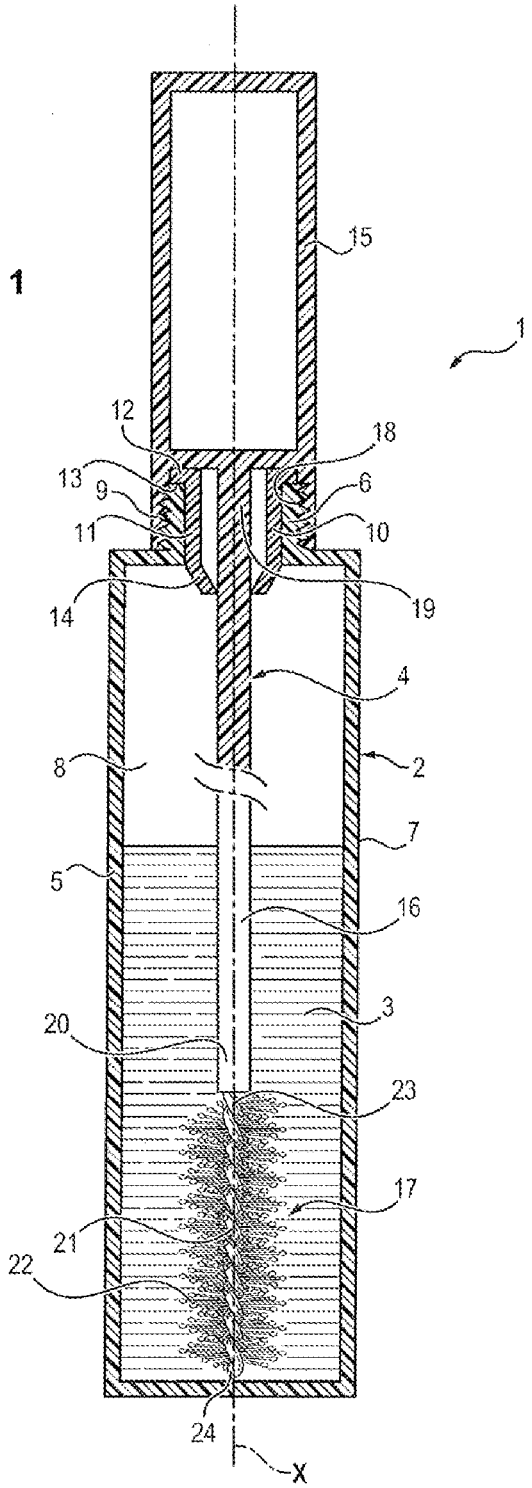
FIG. 1 is a schematic view of a cosmetic product distributor-applicator according to an embodiment of the invention.
Figure 2:
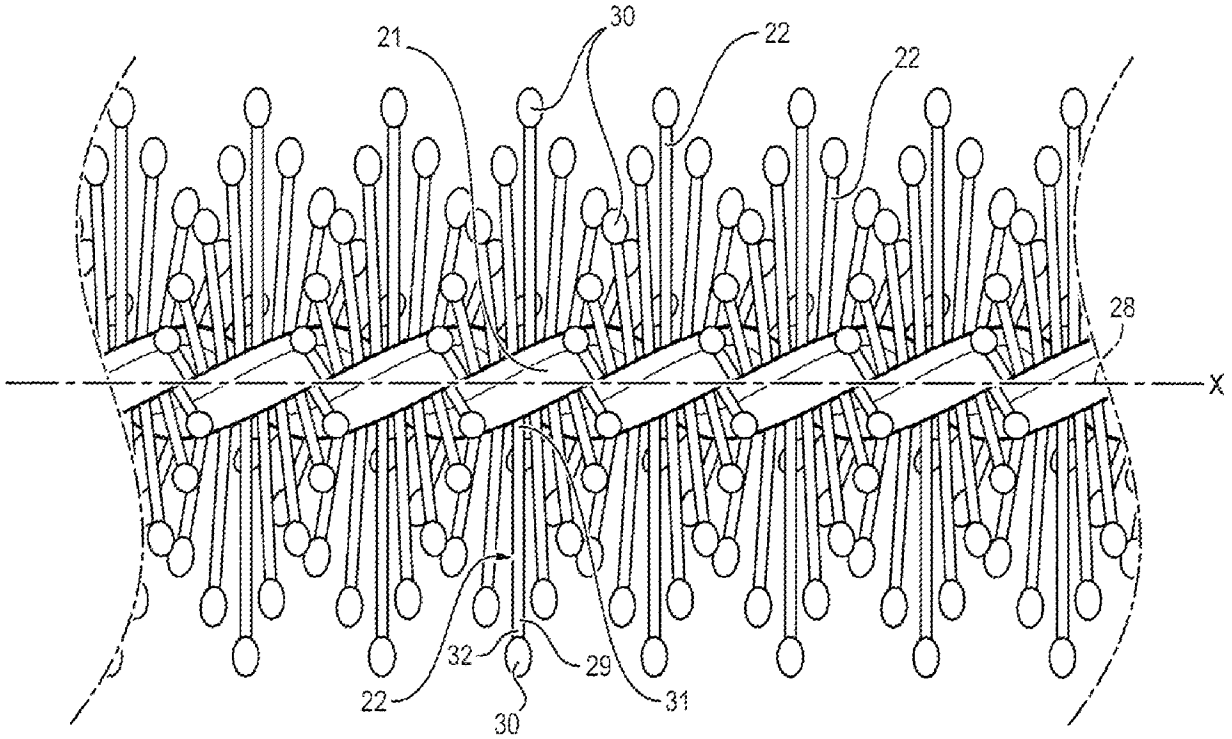
FIG. 2 is a schematic side view of a detail of a brush including a twisted metal core according to an embodiment of the invention.

As shown in FIG. 1, a distributor-applicator 1 includes a receptacle 2 containing a cosmetic product 3 and an applicator 4 capable of being removably attached to the receptacle 2. The receptacle 2 includes a body 5 and a neck 6. The body 5 has a general elongate shape and includes walls 7 delimiting a container 8 which contains the cosmetic product. The neck 6 includes an external surface 9 having a thread. The receptacle 2 also includes a wiper ring 10. The wiper ring 10 is positioned within the neck 6. The wiper ring 10 has a general tubular shape. The wiper ring 10 includes a cylindrical main portion 11 extending within the neck 6, a shoulder 12 capable of resting on a rim 13 of the neck 6 to secure the wiper ring in the neck and a tapered portion 14 of which the diameter decreases towards the interior of the container 8.

The applicator 4 includes a handle 15, a rod 16 and a brush 17. The handle 15 includes an internal surface 18 having a thread. The thread of the handle 15 is capable of mating with the thread of the neck 6 so that the applicator 4 can be attached to the receptacle 2. In this way, the handle 15 acts as a cap for sealing the receptacle 2. The rod 16 has an elongate cylindrical shape having a main direction extending along a longitudinal axis X and includes a first end 19 attached to the handle 15 and a second end 20 to which the brush 17 is attached. The brush 17 includes a core 21 extending in the extension of the rod 16 along the longitudinal axis X and fibers 22 projecting in radial directions from the core 21, the fibers being relatively short elements made of a material of which the thickness (or the diameter) is very low compared with the length. The core 21 has a first end 23 capable of being attached to the second end 20 of the applicator rod 16, and a free second end 24. When the handle 15 is screwed onto the neck 6 of the receptacle 2, the rod 16 and the brush 17 extend within the container 8, the brush 17 being submerged in the cosmetic product 3.

In use, the user unscrews the handle 15 from the neck 6 and removes the applicator 4 from the receptacle 2. During removal, the applicator 4 slides through the wiper ring 10. Owing to the movement of the applicator 4 through the wiper ring 10, the tapered portion 14 of the wiper ring 10 scrapes the excess cosmetic product from the rod 16 and the brush 17.

As shown in FIGS. 2 and 3*a* to 3*g*, each fiber 22 extends from the core 21 in a radial direction relative to the longitudinal axis X, and includes an elongate portion 29 made of a first material and a lobe 30 made of a second material. The lobe 30 is larger than a transverse dimension of the elongate portion 29.

The elongate portion 29 of the fiber 22 includes a first end 31 connected to the core 21 and a second end 32 bearing the lobe 30. The lobe 30 is formed by coating the second end 32 of the elongate portion 29. The lobe 30 can, more particularly, be droplet shaped, mushroom-cap shaped, or can be generally curved so as to be almost ball shaped.

The second material of the lobe 30 is preferably different from the first material of the elongate portion 29.

For example, the elongate portions 29 can be produced from a first material, which is either flexible or rigid. The first material, forming the elongate portions 29, can thus include a thermoplastic polyester elastomer such as Hytrel® (rigid), or nylon 6/12 (flexible).

The second material can include a resin, in particular a two-component epoxy adhesive or an ultraviolet adhesive.

In a first embodiment shown in FIGS. 1, 2, 8*a* and 8*b*, the core 21 of the brush 17 includes a metal wire 28. Each elongate portion 29 forms a bristle part, the metal wire 28 being folded in the manner of a hairpin so as to form two strands, the two strands being twisted together, the bristles being held between the two strands. In this embodiment, it will therefore be understood that each bristle includes the elongate portions 29 of two fibers 22 which are formed in one piece and are held in position by the core 21 owing to the mechanical stress exerted by the two twisted strands.

In a second embodiment shown in FIGS. 3*a* to 3*g*, the core 21 and the elongate portions 29 are formed in one piece, for example by plastics injection moulding. The core 21 and the elongate portions 29 are made of an appropriate material selected for example from: a thermoplastic polyester elastomer such as Hytrel® marketed by DuPont, a thermoplastic polyurethane elastomer such as Pellethane® marketed by Dow, a mixture of thermoplastic materials such as T-BLEND® marketed by TSRC, primarily including poly (styrene-butadiene-styrene) (SBS) or poly(styrene-ethylene-butylene-styrene) (SEBS), a low-density polyethylene (LDPE) or an ethylene alpha-olefin copolymer such as Exact® marketed by ExxonMobil.

Optionally, in order to minimise the risk of injury due to the fibers 22 accidentally contacting the eye, the second material can further include a dye, for example a red dye. In this way, the lobes 30 of the fibers 22 are easily visible to the user.

In addition, the user can visually check that the entirety of the fibers 22 is loaded with cosmetic product 3, which improves the application to all of the eyelashes.

The elongate portions 29 preferably have a large diameter, for example of between 6 millimeters and 12 millimeters. In addition, the density of fibers 22 around the core 21 can be reduced. For example, in the case of a brush including a twisted core 21, the fibers 22 are arranged helically and the density of the fibers 22 is between eight and eighty fibers 22 per turn of the helix, for example approximately sixteen fibers 22 per turn of the helix about the core 21. It will therefore be understood that, when pairs of the fibers 22 form bristles passing through the metal strands of the core, the brush 17 thus includes between four and forty bristles per turn of the helix, for example approximately eight bristles per turn of the helix about the core 21.

The opening in the brush 17, which is proportional to the space between each fiber 22, is thus large, and this allows the eyelashes to penetrate deeper into the brush 17 and to receive a greater quantity of cosmetic product 3.

According to an embodiment, only some of the fibers 22 include lobes 30, the rest of the fibers 22 not including lobes 30. When a fiber 22 does not have a lobe 30, the second end 32 of the elongate portion 29 is free.

Figure 3A:
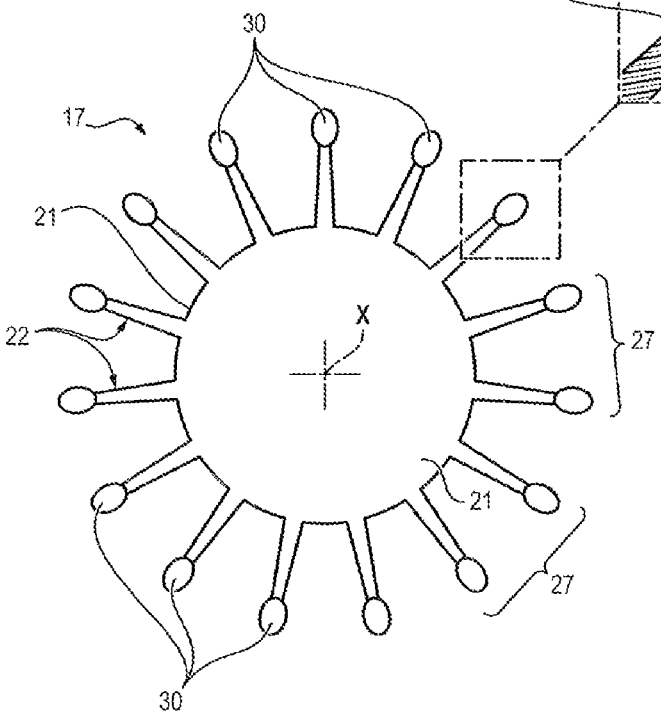
FIG. 3*a* is a schematic cross-section of a first variant of a brush of which the core and the elongate portions have been produced by injection moulding, according to another embodiment of the invention.
Figure 3B:
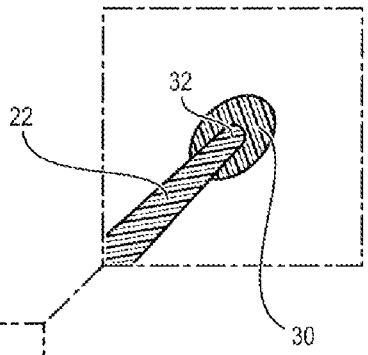
FIG. 3*b* is a detailed cross-section of an end of a fiber according to a first embodiment.
Figure 3C:
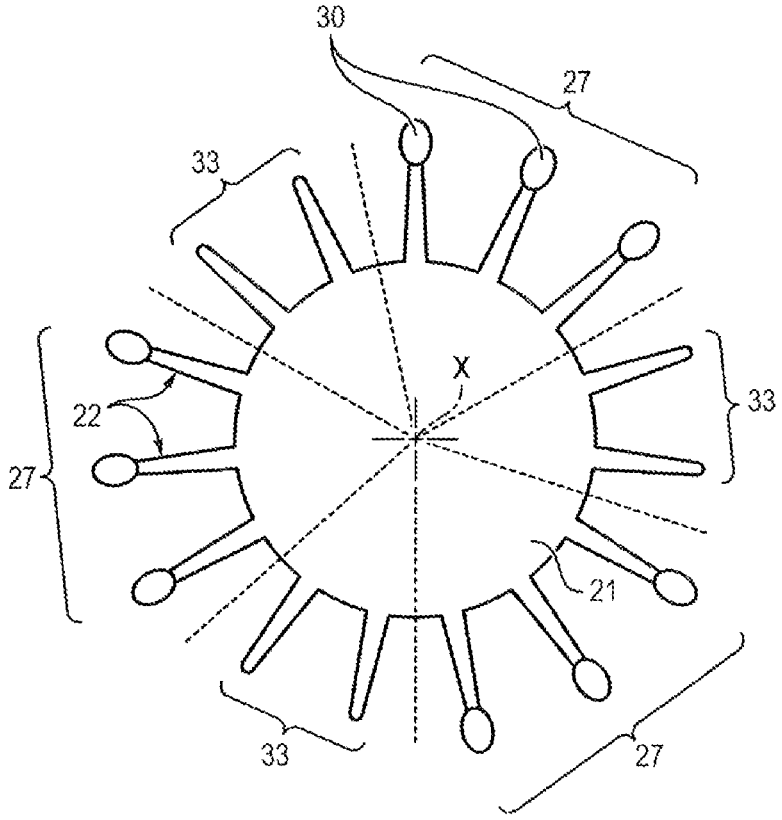
FIGS. 3*c* to 3*g* are schematic cross-sections of additional variants of a brush of which the core and the elongate portions have been produced by injection moulding, according to the other embodiment of the invention.
Figure 3D:
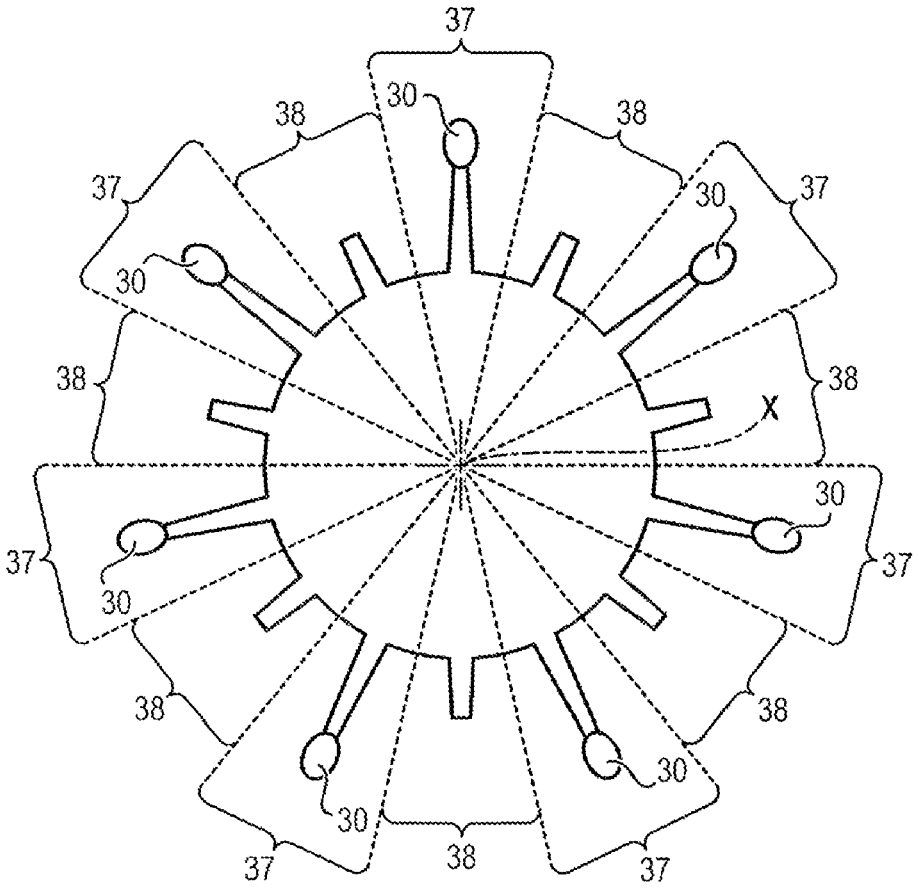

For example, in FIGS. 3*c* and 3*d*, the brush 17 is divided into a series of angular sectors 27 and 33, 37 and 38, 39 and 40 or 41 and 42, distributed around the longitudinal axis X of the core 21, each angular sector being delimited by radial planes passing through the axis X, and containing no, one or several fibers 22.

In some sectors 27, as shown in FIG. 3*c*, the fibers 22 include lobes 30, whereas in other sectors 33, the fibers 22 do not include lobes 30. The sectors 27 in which the fibers 22 include lobes 30 and the sectors 33 in which the fibers 22 do not include lobes 30 can alternate around the axis X.

In a variant, as shown in FIG. 3*d*, in some sectors 37, the fibers 22 include lobes 30, whereas in other sectors 38, the fibers 22 are shorter and do not include lobes 30 in the region of the free end 21 thereof. In this variant, the fibers 22 of the sectors 38 can be produced either by cutting the free end 32 thereof in the case of twisted brushes 17, or can be produced directly during moulding in the case of brushes 17 produced by plastics injection moulding. The sectors 37 and 38 can alternate around the axis X, and can each include one or more fibers 22, for example.

Figure 3E:
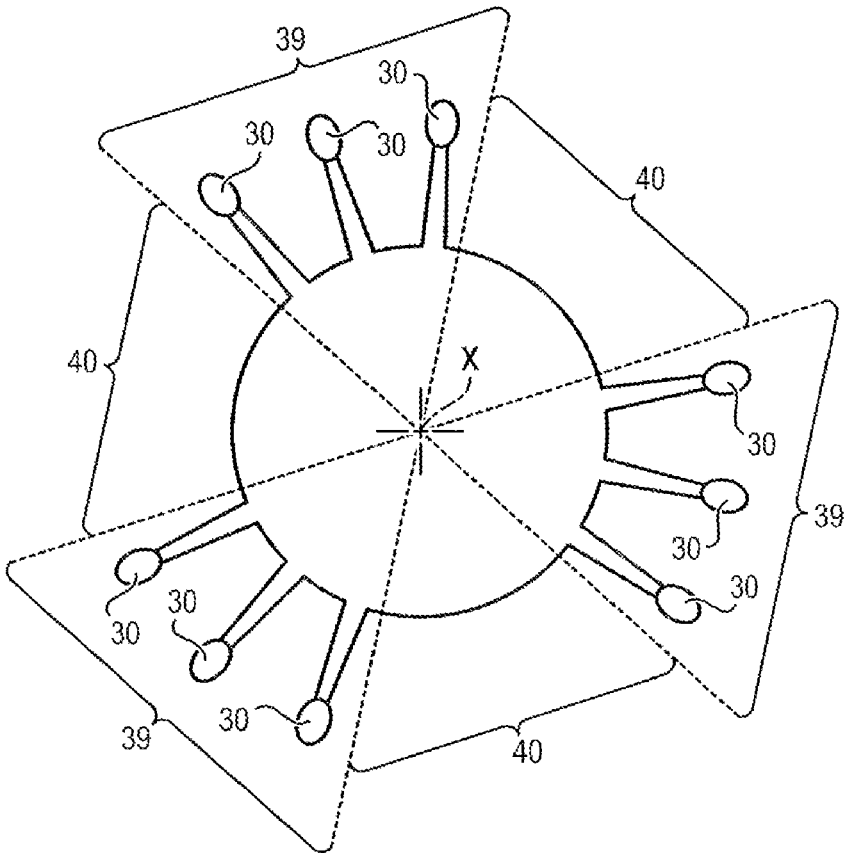
Figure 3F:
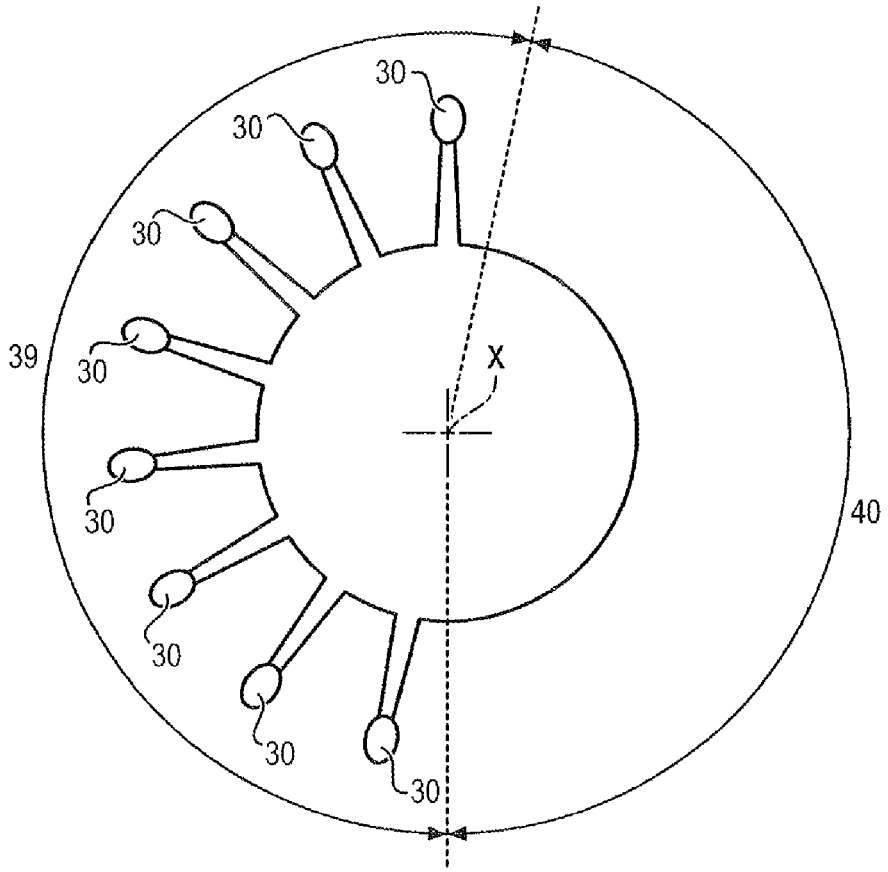

According to another variant, shown in FIGS. 3*e* and 3*f*, the brush 17 includes sectors 39 each including one or more fibers 22 which include lobes 30, and sectors 40 which do not include fibers 22. The sectors 40 not including fibers 20 can be produced either by cutting the fibers 22 in the region of the free end 31 thereof (which is adjacent to the core 21) in the case of twisted brushes 17, or can be produced directly owing to the design of the brush 17 during moulding in the case of brushes 17 produced by plastics injection moulding. In addition, the sectors 39 and 40 can alternate around the axis X.

Figure 3G:
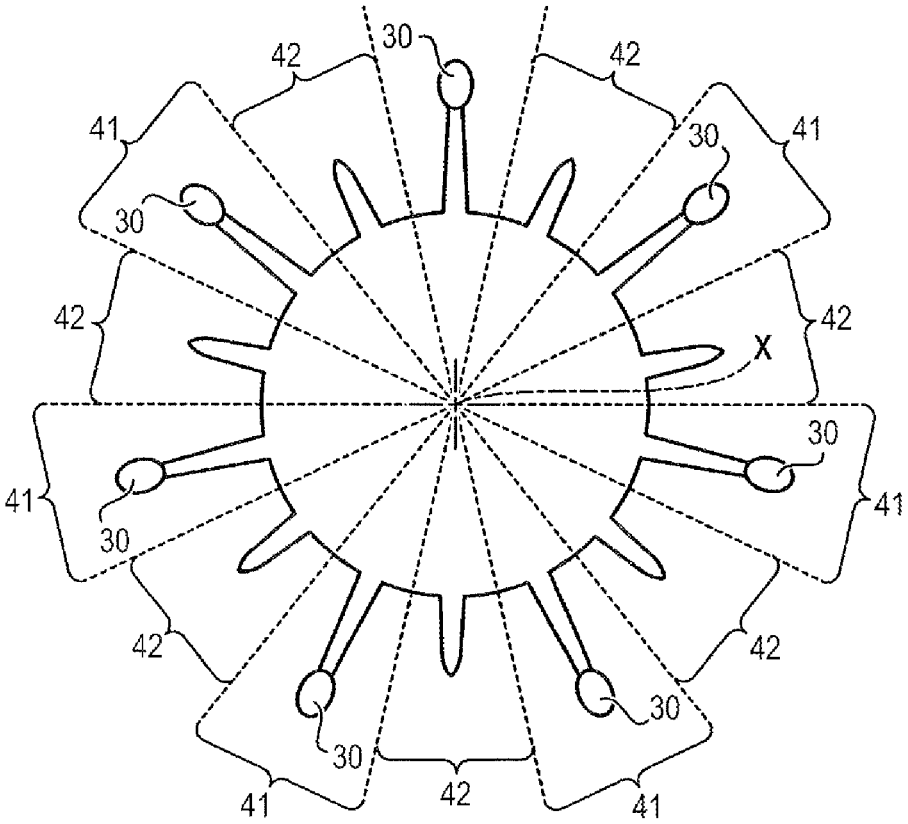

According to yet another variant, shown in FIG. 3*g*, the fibers 22 in some sectors 41 are longer than the fibers 22 in other sectors 42. In this variant, the difference in length of the fibers 22 results from the choice of the fibers 22 depending on the respective lengths thereof, and not from possibly cutting the free end 32 of some fibers. The fibers 22 of the sectors 41 further include lobes 30, whereas the fibers 22 of the sectors 42 do not include lobes 30. The sectors 41 and 42 can alternate around the axis X, and can each include one or more fibers 22, for example.

It will of course be understood that the variants in FIGS. 3*c* to 3*g* can be combined, it being possible for the same brush to include several types of sector from the angular sectors 27, 33 and 37 to 42.

Figure 8A:
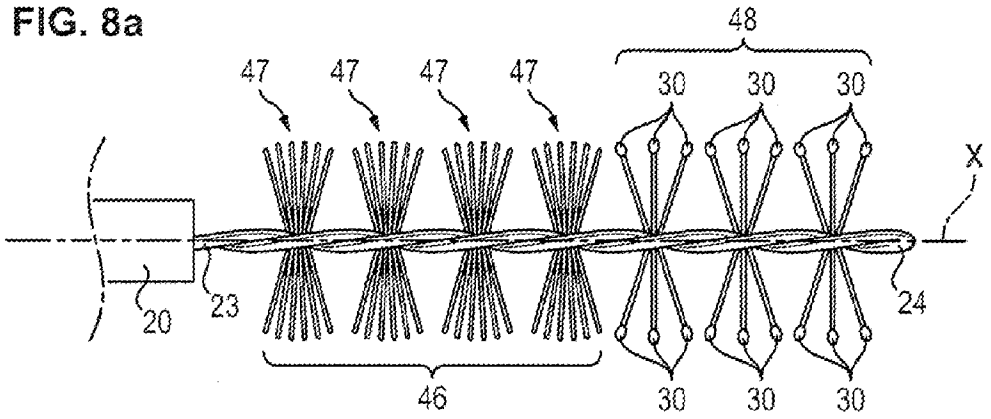
FIGS. 8*a* and 8*b* are schematic side views of a brush of which the core is twisted, according to the first embodiment, and of regions which have different fiber densities per turn of the helix about the core.

Finally, as shown in FIG. 8*a*, the brush 17 can also include, along the longitudinal axis X, two regions 46, 48 which have different fiber densities per turn of the helix about the core 21. For example, a first 46 of the two regions 46, 48 may include fibers 47 having a small diameter, which can in particular form flexible bristles, whereas the second region 48 includes fibers 22 having a large diameter, of which the free end can be coated by a lobe 30 produced from the second material. The region 48 can thus include fibers 22 of which the free end 32 is coated by a lobe 30, and, where appropriate, sectors 27, 33, 37-42 as described above.

Figure 8B:
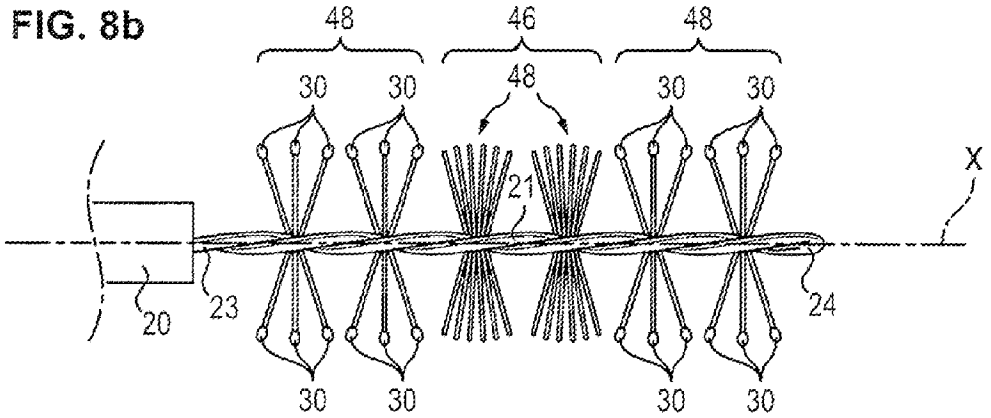

In a variant, the brush 17 can include several alternating regions 46, 48 along the longitudinal axis X which have different fiber densities per turn of the helix about the core 21. For example, as shown in FIG. 8*b*, the brush 17 can include, in the region of the end 23 thereof, a region 48 including fibers 22 of which the free end can be coated with a lobe 30 produced from the second material, then a region 48 including fibers 47 having a small diameter, and finally, in the region of the end 24, a region 48 including fibers 22 of which the free end can be coated with a lobe 30 produced from the second material.

The brush 17 thus obtained, having different fiber densities per turn of the helix, is thus easier to use and gentler to the eyes owing to the regions 46 having a high density of fibers 47 per turn of the helix about the core 21, while allowing greater loading of product owing to the low-density regions 48 and including fibers 22 of which the free end can be coated with a lobe 30.

Figure 4:
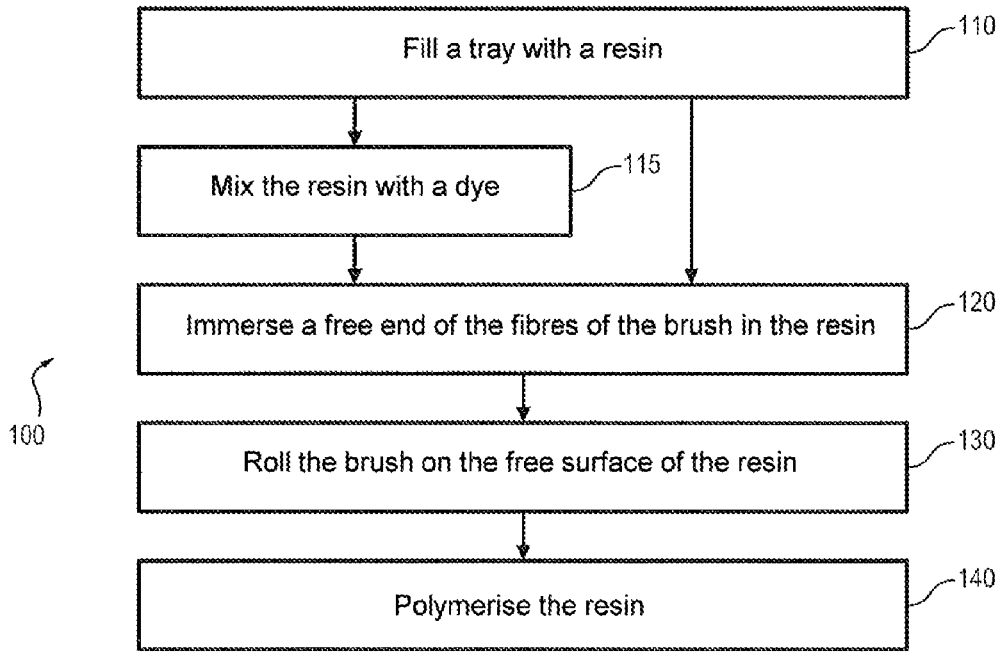
FIG. 4 shows a flow chart showing different steps of an embodiment of the method for producing a cosmetic product applicator according to the invention.

FIG. 4 schematically shows the steps of a method for producing 100 an applicator 4 for a cosmetic product 3 according to the present invention.

During a preliminary step, the rod 16 of the applicator 4 is produced, and the free end 20 thereof is provided with the brush 17. The rod 16 and the brush 17 can be separately produced from plastics material, from materials which are preferably different. In a variant, the brush 17 can include a core 21 including a metal wire which is bent back on itself so as to be in the shape of a hairpin having two strands. The elongate portions 29 forming the fibers are inserted between the two strands and then the two strands are twisted together so as to hold the elongate portions 29 in position.

Since this preliminary step is conventional, it will not be described in detail here.

The lobes 30 are then produced on the free ends 32 of the elongate portions 29.

For this purpose, in a first step 110, a tray 34 is filled with a resin 35, for example two-component epoxy adhesive or ultraviolet adhesive.

In a second optional step 115, the second material is prepared by mixing the resin 35 with a dye to give the resin 35 a particular hue.

In a third step 120, the free ends 32 of the elongate portions 29 are coated with the second material 35. This step is carried out by dipping the free ends 32 of the elongate portions 29, angular sector by angular sector, into the resin 35. The elongate portions 29 are dipped by a sufficient length L such that the ends 32 thereof are coated with the resin. For example, the elongate portions 29 can be dipped by a length L of approximately three millimeters.

Figure 5:
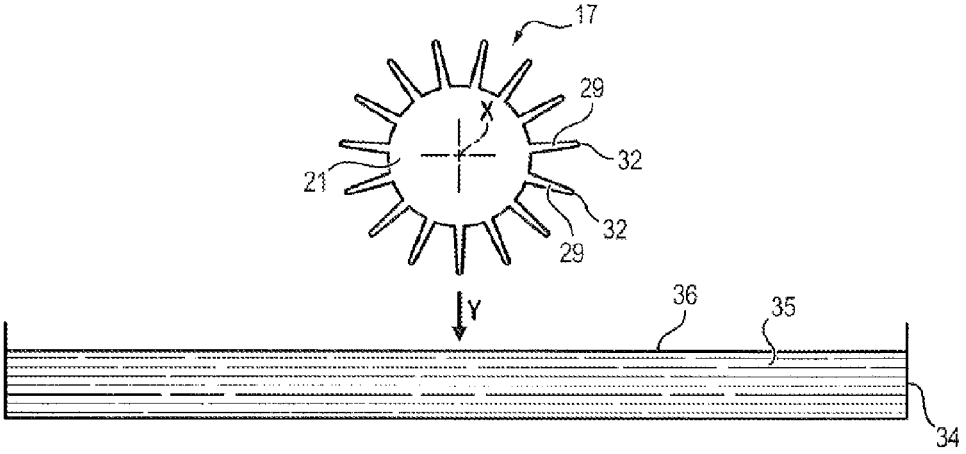
FIGS. 5 and 6 are schematic views of the steps of the method from FIG. 4.

As shown in FIG. 5, the core 21 can for example be positioned parallel to the free surface 36 of the second material 35 contained in the tray 34 and the brush 17 can be moved perpendicular to the free surface 36 of the second material 35 (Y direction) to immerse the free ends 32 of the elongate portions 29 of a given sector 27 in the second material 35.

In a fourth step 130, the brush 17 is moved relative to the tray 34 so as to roll the brush 17 on the free surface 36 so as to cover, sector 27 by sector 27, all the elongate portions 29.

Figure 6:
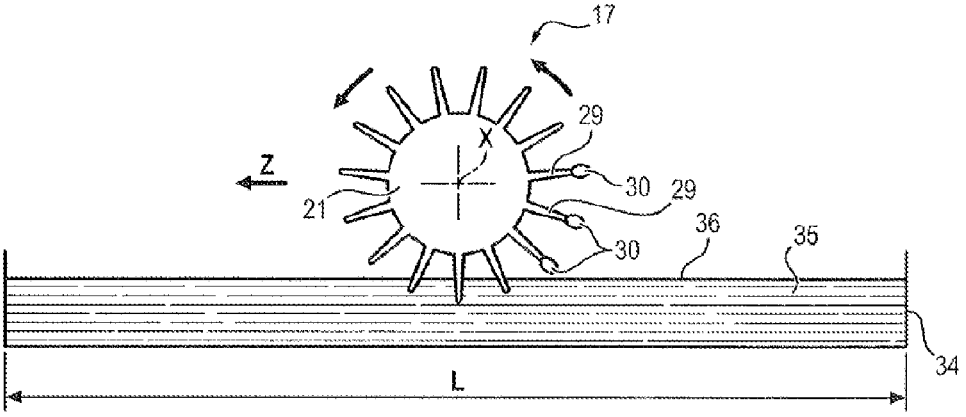

As shown in FIG. 6, the brush 17 is moved relative to the tray 34 parallel to the free surface 36 (Z direction), while being driven in rotation about the longitudinal axis X of the core 21.

In particular, the instantaneous speed of a free end 32 of an elongate portion 29 relative to the core 21 can be equal to the speed of movement in translation of the brush 17 relative to the tray 34, such that the brush 17 rolls in the tray 34.

It will be understood that this is a movement of the core 21 relative to the tray 34, it being possible for the core 21 to remain stationary while the tray 34 is moved, or conversely for the tray 34 to remain stationary while the core 21 is moved.

In this embodiment, the length L of the tray 34 has to be at least equal to the distance covered by the brush 17 during coating of the free ends 32 of the entirety of the elongate portions 29, or at least equal to the maximum circumference of the brush 17.

In a variant, the brush 17 is only rotated above the tray 34, and the core 21 is not driven in translation relative to the tray 34. The length L of the tray 34 therefore does not need to be greater than the largest diameter of the brush 17.

Where appropriate, it is possible to only coat the elongate portions 29 in some sectors 27 of the brush 17, the other sectors 33 having fibers 22 which do not include a lobe 30. For this purpose, the brush 17 can be moved away from the tray 34 when one of these sectors 33 comes to face the second material 35, such that the free end 32 of the elongate portions 29 of this sector 27 is not immersed in the second material 35, while continuing to drive the brush 17 in rotation relative to the tray 34. Then, when the next sector 27 of which the elongate portions 29 have to be coated is facing the surface 36, the brush 17 can be brought closer again to immerse the elongate portions 29 in the second material 35 and to continue coating the free ends 32 of the elongate portions 29.

In addition, in the case of the variants shown in FIGS. 3*d* to 3*g*, the method can include a preliminary step of preparing the fibers 22 of all or some of the sectors forming the brush 17.

Therefore, the fibers 22 of certain sectors 38, 40 can for example be cut prior to the step 120 of coating the free ends 21 of the fibers, either in the region of the free end thereof 32 (sectors 38) or in the region of the fixed end 31 thereof in the region of the core 21 (sectors 40). In a variant, the fibers 22 of some sectors 42 can be produced so as to be shorter than the fibers of other sectors 41, in particular at the time of manufacture. In this way, only some of the sectors (sectors 37, 39 and 41 in FIGS. 3*d* to 3*g*) include fibers 22 long enough for the free end 32 thereof to be dipped into the tray 34, and can be coated by the second material 35.

In a fifth step 140, the lobes 30 formed are polymerised in a polymerisation process adapted to the type of resin used to form the second material 35. For example, in the case of the two-component epoxy adhesive, the polymerisation can be carried out by heat drying in an oven, whereas in the case of the ultraviolet adhesive, the polymerisation is carried out using ultraviolet radiation in a suitable chamber.

According to the dimensions sought for the lobes 30 and the type of resin used, it is possible to perform several successive dipping cycles, each dipping cycle being followed or not being followed by a polymerisation process. For example, for the two-component epoxy adhesive or the ultraviolet adhesive, two (or more) successive passages can be provided in the tray for the elongate portions 29 to be coated by the lobes 30.

Finally, in each dipping cycle, it is possible to modify the second material 35 used for the coating. A lobe 30 can then include a first layer produced from a certain resin, having a certain dye added thereto, and a second layer produced from a different resin and/or a different dye.

The lobes 30 can therefore include one or more layers of material, which can include different materials.

Figure 7A:
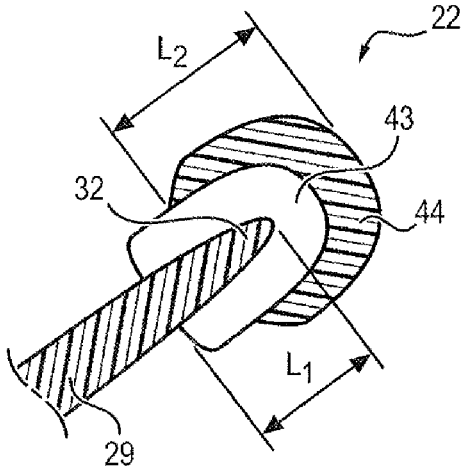
FIG. 7*a* is a detailed cross-section of a free end of a fiber according to a second embodiment.

FIG. 7*a* shows, for example, the case in which a lobe 30 includes two layers 43, 44 of material. The lobe 30 is produced in this case by successively dipping the free end 32 of the fiber 22 into two materials which can be identical or different, possibly together with an intermediate step of polymerising the first layer 43.

In this case, the second material 35 therefore includes two identical or different materials.

The immersion depth of the fibers 22 can be altered from one dip to another. For example, the fibers 22 can be dipped by a first length L1 during the first dip to produce the first layer 43, and then by a second length L2, which can be shorter, to produce the second layer 44. The first layer 43 of the lobe 30 therefore coats the fiber by a length which is substantially equal to L1 and creates an increased thickness in the region of the free end 32 thereof, while the second layer 44 of the lobe 30 only coats the first layer 43 in part since the fibers are dipped by a length L2 which is shorter than L1, and said second layer therefore does not come into direct contact with the fiber 22. By way of non-limiting example, L1 can be approximately 3 mm, while L2 can be approximately 2 mm.

In order to produce said layers 43, 44 of the second material, the height of the brush 17 relative to the tray can in particular be altered between two dipping steps by shifting the brush 17 perpendicular to the free surface 36 (Y direction).

Figure 7B:
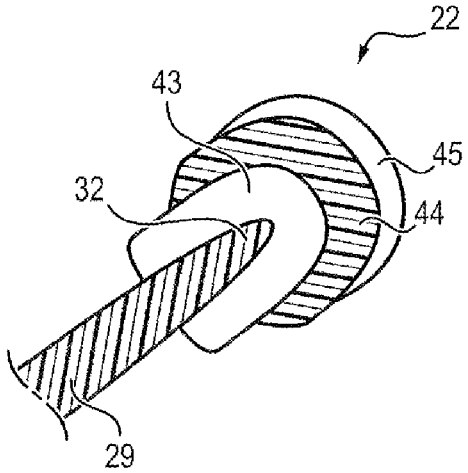
FIG. 7*b* is a detailed cross-section of a free end of a fiber according to a third embodiment.

In a variant, the immersion depth of the free end 32 of the fiber can be altered from one dip to another so as to systematically immerse the fibers 22 by an identical length L1. In this case, the brush 17 remains at a constant height relative to the tray 34 when producing the layers 43 and 44. FIG. 7*b* shows, for example, the case in which a lobe 30 includes three layers 43, 44, 45 of material. In this case, the lobe 30 is produced by successively dipping the free end 32 of the fiber 22 into three materials, which can be identical or different.

In this embodiment, the second material 35 therefore includes three identical or different materials.

Again, the immersion depth of the fibers 22 can be altered from one dip to another by shifting the brush 17 perpendicular to the free surface 36 (Y direction), or said depth can be altered from one dip to another so as to systematically immerse the fibers 22 by an identical length.

What is claimed is:

1. A method for producing a cosmetic product applicator comprising:

dipping at least some of different free ends of elongate portions of fibers of a brush into a second material of a lobe arranged at an end of each of the elongate portions in order to coat each free end of the elongate portions with the second material to form the lobe, the brush comprising a core and the fibers projecting from the core, the fibers comprising the elongate portions made of a first material and the lobe arranged at an end of each of the elongate portions, the lobe being made of the second material coating the ends of the elongate portions, the brush additionally comprising a series of angular sectors extending radially around the core, each angular sector comprising at least one fiber, and wherein, during dipping, the different free ends of the elongate portions are immersed sector by sector in a tray containing the second material;

moving the brush during dipping the elongate portions, in translation parallel to a free surface of the second material contained in the tray at a speed of movement in translation, and simultaneously driving the brush in rotation about a longitudinal axis (X) of the core at a speed of rotation, the speed of movement and the speed of translation being such that an instantaneous speed of a free end of an elongate portion relative to the core is equal to the speed of movement in translation of the brush relative to the tray, such that the brush rolls in the tray.

2. The method of claim 1, wherein only the free ends of the elongate portions are dipped into the second material.

3. The method of claim 1, further comprising cutting all or some of the elongate portions of at least one sector prior to dipping.

4. The method of claim 1, wherein the dipping of at least one of the elongate portions into the second material is repeated at least once.

5. The method of claim 1, wherein the dipping of at least one of the elongate portions into the second material is repeated twice.

6. The method of claim 1, further comprising polymerizing the second material coating the end of all or some of the elongate portions.

* * * * *